US009453641B2

(12) United States Patent
Cadima

(10) Patent No.: US 9,453,641 B2
(45) Date of Patent: Sep. 27, 2016

(54) GAS BURNER WITH STABILITY CHAMBER AND GROOVED CAP

(71) Applicant: General Electric Company, Schenectady, NY (US)

(72) Inventor: Paul Bryan Cadima, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 335 days.

(21) Appl. No.: 14/169,196

(22) Filed: Jan. 31, 2014

(65) Prior Publication Data

US 2015/0219340 A1 Aug. 6, 2015

(51) Int. Cl.

| | |
|---|---|
| ***F24C 3/08*** | (2006.01) |
| ***F23D 14/26*** | (2006.01) |
| ***F24C 3/10*** | (2006.01) |
| ***F23D 14/06*** | (2006.01) |

(52) U.S. Cl.
CPC ..... *F23D 14/26* (2013.01); *F23D 14/06* (2013.01); *F24C 3/08* (2013.01); *F24C 3/10* (2013.01)

(58) Field of Classification Search
CPC ..... F23D 14/26; F23D 14/06; F24C 3/08; F24C 3/10
See application file for complete search history.

(56) References Cited

U.S. PATENT DOCUMENTS

| | | | |
|---|---|---|---|
| 5,133,658 | A | 7/1992 | Le Monnier De Gouville et al. |
| 5,800,159 | A | 9/1998 | Maughan et al. |
| 7,841,332 | B2 | 11/2010 | Pottenger et al. |
| 8,171,927 | B2 | 5/2012 | Pryor et al. |

*Primary Examiner* — Alfred Basichas
(74) *Attorney, Agent, or Firm* — Dority & Manning, P.A.

(57) ABSTRACT

A gas burner assembly for an appliance is provided. The gas burner has a gas stability chamber for providing a re-ignition source to primary burner ports positioned around the burner. A burner cap is provided with an annular groove for properly positioning the cap onto the burner.

10 Claims, 6 Drawing Sheets

GAS BURNER WITH STABILITY CHAMBER AND GROOVED CAP

FIELD OF THE INVENTION

The subject matter of the present disclosure relates generally to a gas burner for the cooktop of an appliance.

BACKGROUND OF THE INVENTION

Gas burners are commonly used on the cooktops of household gas cooking appliances including e.g., range ovens and cooktops built into cabinetry. A significant factor in the performance of gas burners is their ability to withstand airflow disturbances in the surroundings, such as room drafts, rapid movement of cabinet doors, and most commonly rapid oven door manipulation. For appliances which comprise both an oven and cooktop, manipulation of the oven door can be particularly troublesome because rapid openings and closings of the oven door can produce respective under-pressure and over-pressure conditions within the oven cavity. These pressure changes may cause rapid expansion and/or contractions in the structures. As a result, a large amount of air passes through or around the gas burners with e.g., rapid opening or closing of the oven doors. Similarly for built in cooktops, pressure changes due to rapid manipulation of surrounding cabinets may result in large amounts of airflow through or around the gas burners.

Such surges of air around the gas burners, due to pressure disturbances in the surroundings, are detrimental to the flame stability of the burners and may cause extinction of the flames. This flame stability problem is particularly evident in sealed gas burner arrangements, which lack an opening in the cooktop surface around the base of the burner so as to prevent spills from entering the area beneath the cooktop.

The inherent cause of this flame instability is the low pressure drop of the fuel/air mixture passing through the burner ports of a typical burner used on the cooktop of an appliance. Although there is ample pressure available in the fuel, the pressure energy is used to accelerate the fuel to the high injection velocity required for primary air entrainment. Relatively little of this pressure is available at the burner ports. A low pressure drop across the ports allows pressure disturbances propagating through the ambient to easily pass through the ports, momentarily drawing the flame towards the burner head and leading to thermal quenching and extinction.

An additional problem is that rapid adjustments of the fuel supply to a gas burner from a high burner input rate to a low burner input rate often will cause flame extinction when the momentum of the entrained air flow continues into the burner even though fuel has been cut back, resulting in a momentary drop in the fuel/air ratio, and causing extinction.

A solution to the above-described problem is the use of a stability chamber as described e.g., in U.S. Pat. No. 5,800,159, commonly owned by the assignee of the present invention. In one embodiment, the stability chamber is formed from baffles extending radially outward from a burner throat and in a widening manner towards a simmer flame port. Primary burner ports are positioned proximate the simmer flame port. Tangentially fed inlets to the stability chamber are positioned proximate the burner throat. The burner is able to maintain the simmer flame at both low and high settings so that the simmer flame can relight the flame at the primary burner ports when needed.

A portion of the stability chamber is formed by a burner cap placed over the top of the burner. For proper burner operation, proper placement of the burner cap onto the burner body is necessary. In one conventional construction, the burner cap is maintained in place on the burner body by a plurality of pegs that extend from the bottom of the burner cap into the burner body. These pegs are welded to the cap—adding expense and complexity to manufacture. To avoid the use of such pegs, another conventional construction uses an annular groove formed in the burner cap that aligns with projections in the burner so as to properly position the burner cap.

Unfortunately, the annular groove can prevent or impede the proper functioning of a burner that is equipped with a stability chamber. More particularly, the groove can overlap with the baffles or walls of the stability chamber. This can cause several problems. For example, excessive fuel may be fed into the chamber through the groove. For smaller burners, the grooves may also overlap gas inlet ports on the baffles, which can lead to flashback of the flame into the burner.

Accordingly, a burner having one or more features for properly locating the burner cap onto the burner body would be useful. A burner having such features without interfering with the proper operation of a stability chamber of the burner would be particularly beneficial.

BRIEF DESCRIPTION OF THE INVENTION

The present invention provides a gas burner assembly for an appliance that has a gas stability chamber for providing a re-ignition source to primary burner ports positioned around the burner. A burner cap is provided with an annular groove for properly positioning the cap onto the burner. Additional aspects and advantages of the invention will be set forth in part in the following description, or may be apparent from the description, or may be learned through practice of the invention.

In one exemplary embodiment, the present invention provides a gas burner assembly for a cooktop of an appliance. The assembly includes a burner body having an annular sidewall surrounding a throat defined by a main gas conduit having a gas inlet and a gas outlet. The burner body defines at least one projection extending along an axial direction from the burner body. A cap is received onto the burner body and defines an annular groove configured to receive the at least one projection and position the cap on the burner body. The cap also has a recessed center portion positioned radially inward of the groove and located over the gas outlet.

A plurality of primary burner ports are positioned along the annular sidewall of the burner body, surround the gas outlet, and are in fluid communication with the main gas conduit through the gas outlet. A simmer flame port is disposed within the sidewall, spaced along a circumferential direction from the primary burner ports, and is configured to provide a reignition source for the primary burner ports. A stability chamber is located radially adjacent to the simmer flame port. The stability chamber is defined at least in part by a pair of radially extending baffles positioned in an opposing manner along the circumferential direction; an upper surface of the burner body; and the cap. At least one stability chamber gas inlet is defined by the annular groove in the cap and a top surface of one the baffles.

In another exemplary embodiment, the present invention provides a gas burner assembly for a cooktop of an appliance that includes a burner body comprising an annular sidewall surrounding a throat defined by a main gas conduit having a gas inlet and a gas outlet. The burner body defines a gas blocking projection extending along an axial direction of the burner body. A cap is received onto the burner body. The cap defines an annular groove into which the gas blocking projection is received in a complementary manner. A plurality of primary burner ports are positioned along the annular sidewall of the burner body. The burner ports surround the gas outlet and are in fluid communication with the main gas conduit through the gas outlet.

A simmer flame port is disposed along the sidewall, spaced along a circumferential direction from the primary burner ports, and is configured to provide a reignition source for the primary burner ports. A stability chamber is located radially adjacent to the simmer flame port. The simmer flame port is defined at least in part by a pair of radially extending baffles positioned in an opposing manner along the circumferential direction; an upper surface of the burner body, and the cap. At least one stability chamber gas inlet is positioned along the baffles and is configured to create a stabilizing pressure drop in the flow of gas through the stability chamber. The gas blocking projection precludes gas flow into the stability chamber through the annular groove.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

The use of identical reference numerals in different figures denotes the same or similar components or features.

DETAILED DESCRIPTION OF THE INVENTION

Figure 1:
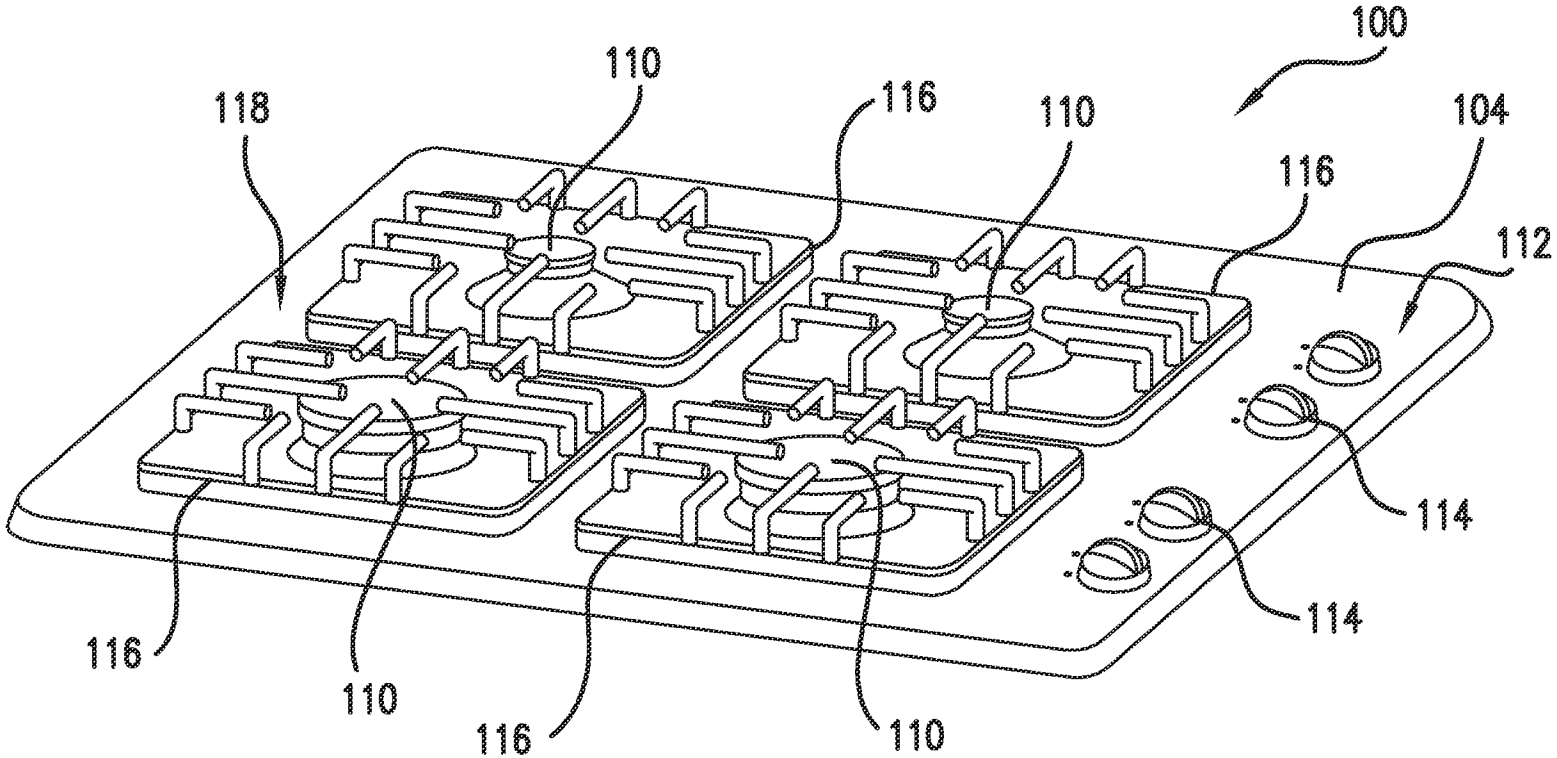
FIG. 1 provides an exemplary embodiment of a cooktop appliance 100 of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates an exemplary embodiment of a cooktop appliance 100 as may be employed with the present subject matter. Cooktop appliance 100 includes a top panel 104. By way of example, top panel 104 may be constructed of glass, ceramics, enameled steel, and combinations thereof. Top panel 104 may be part of a range or other appliance, or panel 104 may be a stand-alone appliance.

For cooktop appliance 100, a utensil holding food and/or cooking liquids (e.g., oil, water, etc.) may be placed onto grates 116 at a location of any of a plurality of burner assemblies 110. As shown in FIG. 1, burner assemblies 110 can be configured in various sizes so as to provide e.g., for the receipt of cooking utensils (i.e., pots, pans, etc.) of various sizes and configurations and to provide different heat inputs for such cooking utensils. Grates 116 are supported on a top surface 118 of top panel 104.

Burner assemblies 110 provide thermal energy to cooking utensils on grates 116. In particular, burner assemblies 110 extend through top panel 104 below grates 116. Burner assemblies 110 are also mounted to top panel 104. Burner assemblies 110 provide for combustion of a gaseous fuel to provide heat energy for cooking.

A user interface panel 112 is located within convenient reach of a user of the cooktop appliance 100. For this exemplary embodiment, panel 112 includes knobs 114 that are each associated with one of burner assemblies 110. Knobs 114 allow the user to activate each burner assembly 110 and determine the amount of heat input provided by each burner assembly 110 to a cooking utensil located thereon. Panel 112 may also be provided with one or more graphical display devices that deliver certain information to the user such as e.g., whether a particular burner assembly is activated and/or the level at which the burner assembly is set.

Although shown with knobs 114, it should be understood that knobs 114 and the configuration of cooktop appliance 100 shown in FIG. 1 are provided by way of example only. More specifically, user interface 112 may include various input components, such as one or more of a variety of touch-type controls, electrical, mechanical or electro-mechanical input devices including rotary dials, push buttons, and touch pads. The user interface 112 may include other display components, such as a digital or analog display device designed to provide operational feedback to a user.

Cooktop appliance 100 shown in FIG. 1 illustrates an exemplary embodiment of the present subject matter. Thus, although described in the context of cooktop appliance 100, the present subject matter may be used in cooktop appliances having other configurations, e.g., a cooktop appliance with one, two, or more additional burner assemblies. Similarly, the present subject matter may be used in cooktop appliances that are part of an oven such as e.g., range appliances.

Figure 2:
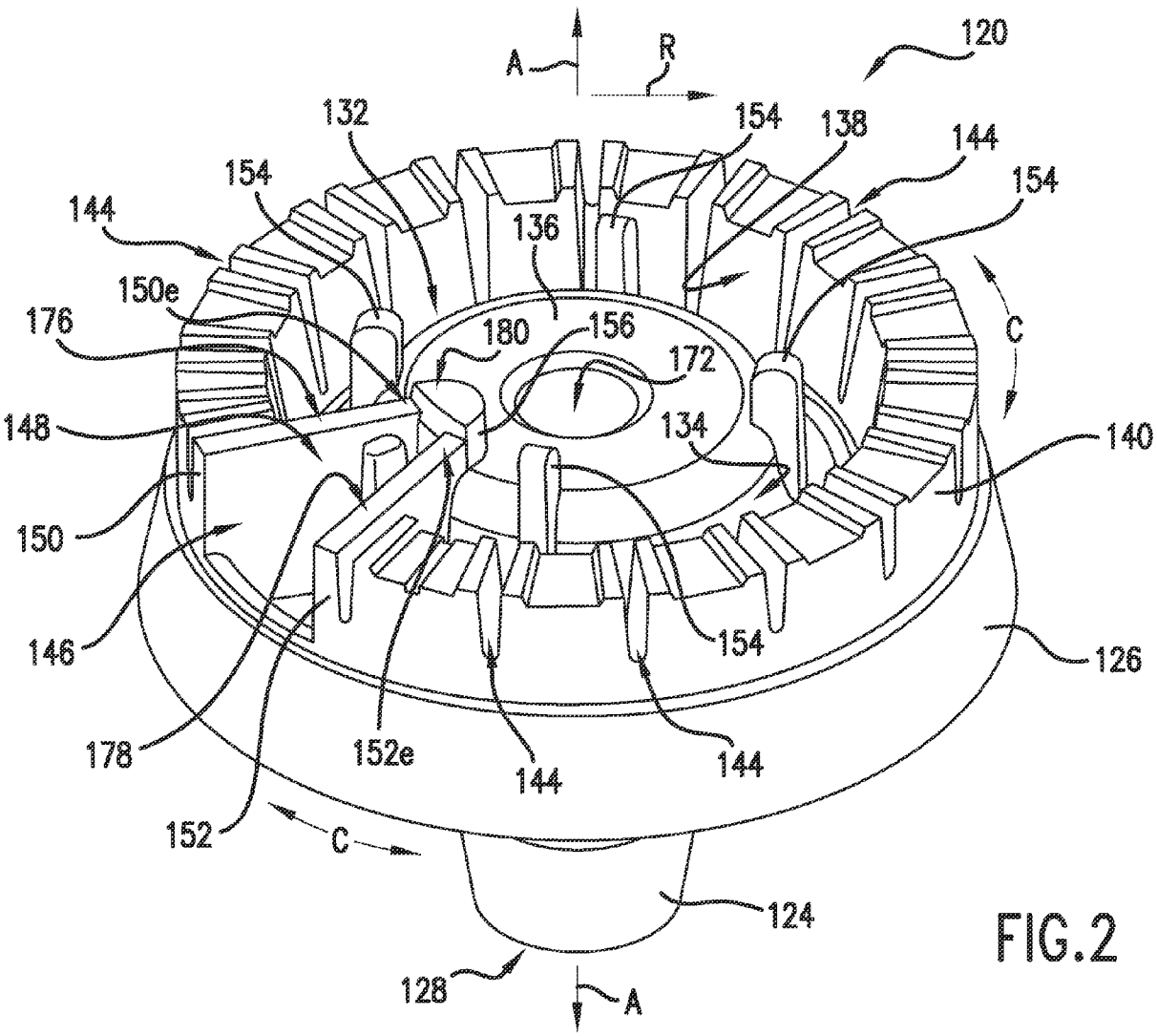
FIG. 2 is a perspective view of an exemplary embodiment of a burner body of the present invention.
Figure 3:
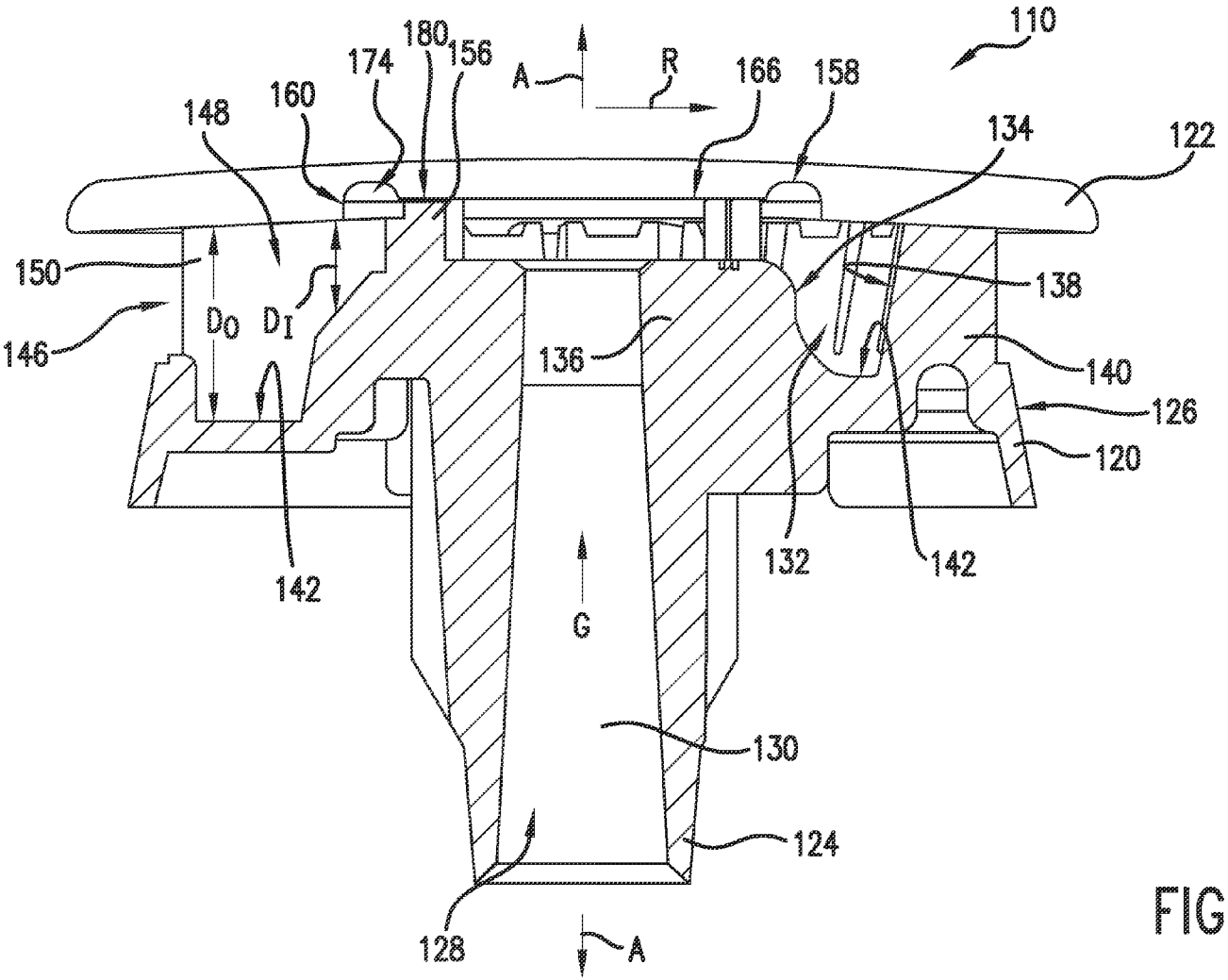
FIG. 3 is a cross-sectional view of an exemplary embodiment of a burner assembly of the present invention that uses the exemplary burner body of FIG. 2.
Figure 4:
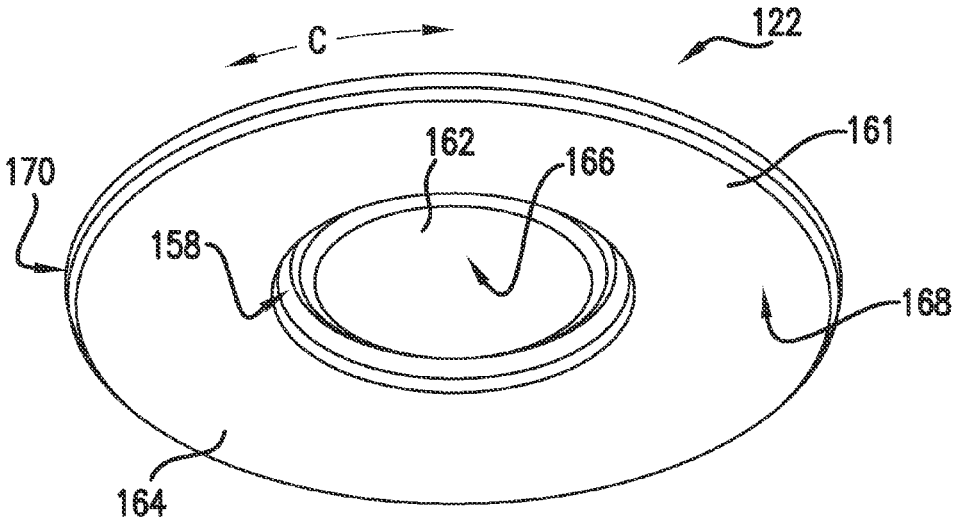
FIG. 4 is a perspective view of the bottom of an exemplary cap used in the burner assembly of FIG. 3.
Figure 5:
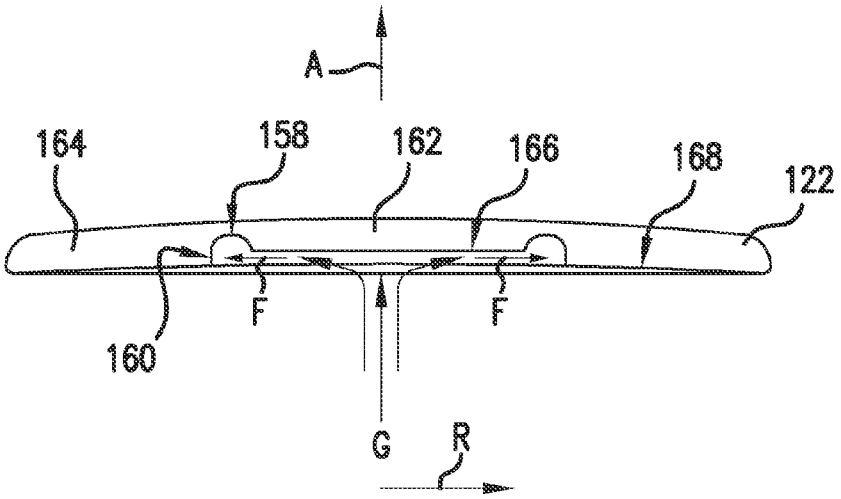
FIG. 5 provides a side view of the exemplary cap of FIG. 4.

FIG. 3 illustrates an exemplary embodiment of a burner assembly 110 as may be used with cooktop appliance 100. FIG. 2 is a perspective view of the burner body 120 as may be used in exemplary burner assembly 110, and FIGS. 4 and 5 illustrate views of an exemplary cap 122 of the burner assembly 110. Burner assembly 110 includes a burner body 120 having a frustrum-shaped base portion 126 and cylindrical or annular sidewall 140 extending along axial direction A from the periphery of base portion 126. Base portion 126 can be e.g., attached to top panel 104 of appliance 100.

Sidewall 140 extends around circumferential direction C of burner body 120. A main gas conduit 124 projects along axial direction A and defines a burner throat 130 having a gas inlet 128 and a gas outlet 172 for gas flow G. As used herein, "gas" or "gas flow" or "fuel" refers to a combustible gas or gaseous fuel mixture. A portion of burner throat 130 and gas outlet 172 are surrounded by sidewall 140.

Sidewall 140 defines a plurality of primary burner ports 144 that, for this exemplary embodiment, are evenly spaced apart from each other along the circumferential direction C and surround gas outlet 172. As used herein, port refers to an aperture or opening of any shape from which a flame may be supported. A cap 122 is received onto the top of burner body 120. An annular main fuel chamber 132 (FIG. 2) is positioned between cap 122 and burner body 120. More specifically, annular main fuel chamber 132 is defined by cap 122, outer surface 134 of toroidal projection 136, inner surface 138 of sidewall 140, upper surface 142 of burner body 120, and a non-recessed surface 168 of cap 122. Through gas outlet 172 and fuel chamber 132, primary burner ports 144 are in fluid communication with gas flow G in the throat 130 of main gas conduit 124.

Cap 122 defines an annular groove 158 into which a plurality of projections 154 are received. Each projection 154 extends along axial direction A and is defined by burner body 120. While four projections 154 are shown, more or less may be used in other embodiments of the invention. The tips of projections 154 are received into annular groove 158 so as to provide for proper positioning of cap 122 over burner body 120. A top surface 180 of an end wall 156 also supports cap 122.

Sidewall 140 defines simmer flame port 146 that is spaced along circumferential direction C from primary burner ports 144 and is configured to provide a reignition source for burner ports 144. While only a single simmer flame port 146 is shown, it should be understood that multiple such ports could be used. Simmer flame port 146 provides a path for fluid communication with stability chamber 148. Simmer flame port 146 and stability chamber 148 are substantially isolated from main fuel chamber 132 and are relatively independent from burner ports 144.

As shown, stability chamber 148 is defined along sides by a pair of radially extending baffles 150, 152 that are positioned in an opposing manner from each other along circumferential direction C, along a bottom by an upper surface 142 of burner body 120, and along a top by an annular projecting portion 164 of burner cap 122. End wall 156 is positioned proximate to gas outlet 172 of burner throat 130 and further defines stability chamber 148 in this exemplary embodiment. As shown, upper surface 142 defines a depth $D_O$ of the stability chamber 148 that is greater nearest simmer flame port 146 than a depth $D_I$ nearest gas outlet 172.

As shown in FIG. 3, stability chamber 148 has a pair of stability chamber gas inlets 174 formed by an annular groove 158 in cap 122 that is positioned radially outward of end wall 156. More particularly, at least one stability chamber gas inlet 174 is formed by annular groove 158 in cap 122 and a top surface 176 of baffle 150. A second stability chamber gas inlet (not shown) is formed by top surface 178 of baffle 152 and annular groove 158. While two stability chamber gas inlets are provided, in other exemplary embodiments 1, 3, or more inlets may be used. As shown, top surfaces 176 and 178 are flat their entire length along radial direction R of each baffle 150 and 152, respectively. Other shapes may be used as well. The stability chamber gas inlets are positioned substantially symmetrically about stability chamber 146 and at radially inward ends 150*e* and 152*e* of baffles 150 and 152 near gas outlet 172.

Referring now to FIGS. 3, 4, and 5, as fuel flows from gas outlet 172 (arrow G in FIG. 5), a portion travels along a radial direction R across a recessed surface 166 provided by a recessed center portion 162 of cap 122 and towards outer peripheral edge 170 (arrows F in FIG. 5). Eventually, this flow F reaches a barrier wall 160 that wraps circumferentially around the gas outlet 172 and extends downwardly along axial direction A. Barrier wall 160 is defined by an annular projecting portion 164 of cap 122 that projects along axial direction A relative to the recessed center portion 162 that is positioned over gas outlet 172. Upon reaching barrier wall 160, a pressure increase occurs that causes the fuel to flow along annular groove 158, through the stability chamber gas inlets (including inlet 174) positioned on both sides of stability chamber 148, and into stability chamber 148. As such, fuel is provided for ignition in stability chamber 148, which in turn serves as an isolated reignition source for primary burner ports 144.

As noted, the top surfaces 176, 178 of baffles 150, 152 are flat, and baffles 150, 152 extend uninterrupted (i.e. no gaps or notches) along radial direction R between port 146 and end wall 156. As such, the amount of flow into stability chamber 148 is controlled by the depth of annular groove 158 and the height of wall 160 along axial direction A. The height of wall 160 depends on the difference in depth along axial direction A of portion 164 relative to portion 162 of cap 122, as well as the radial distance between said groove and the axis of mixing throat 130. These parameters can be readily tuned or modified for different burner assemblies based on other variables affecting the gas flow rate. At the same time, annular groove 158 serves to position cap 122 over burner body 120 as previously described.

Figure 6:
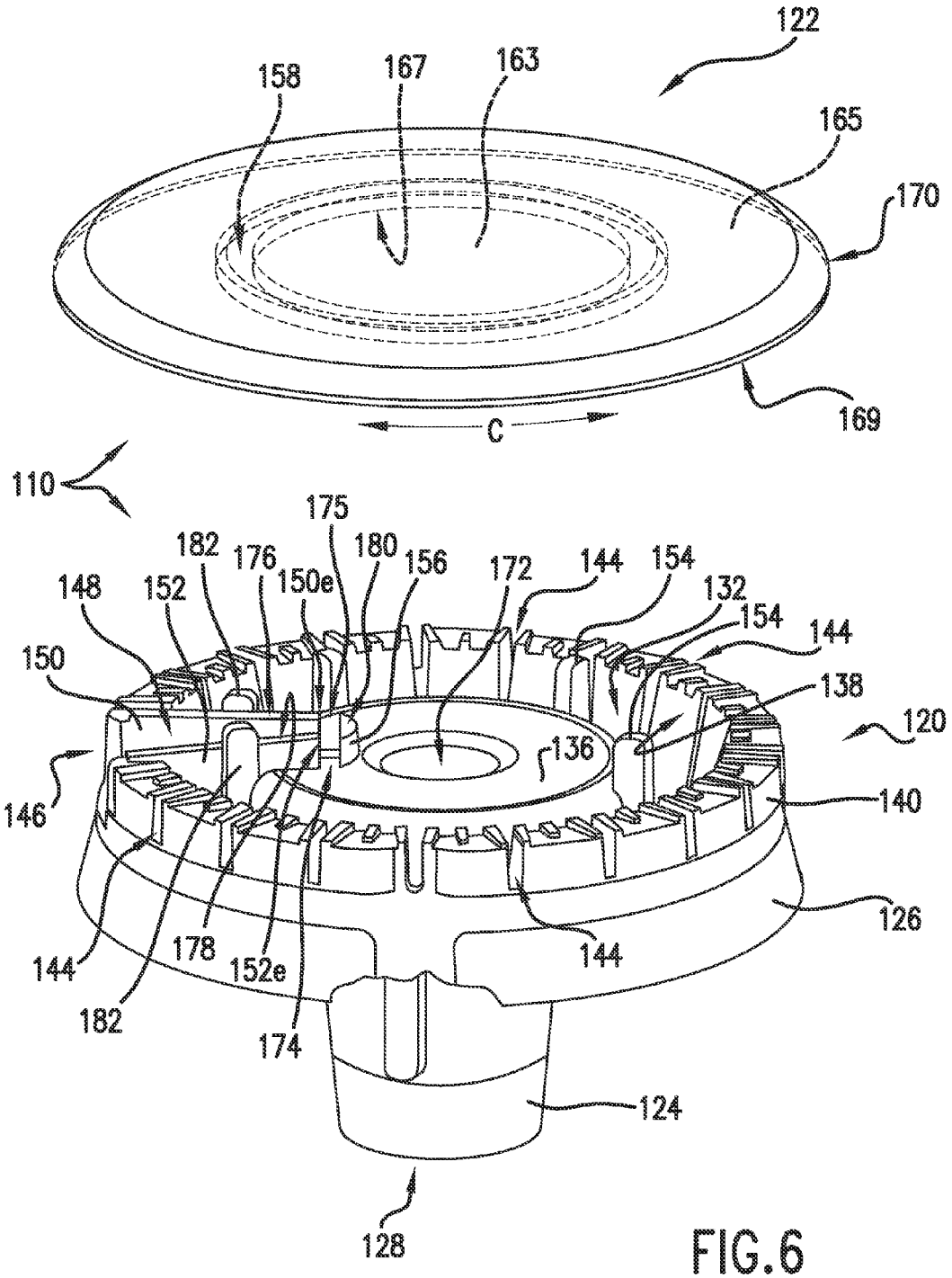
FIG. 6 is an exploded view of another exemplary embodiment of a burner assembly.
Figure 7:
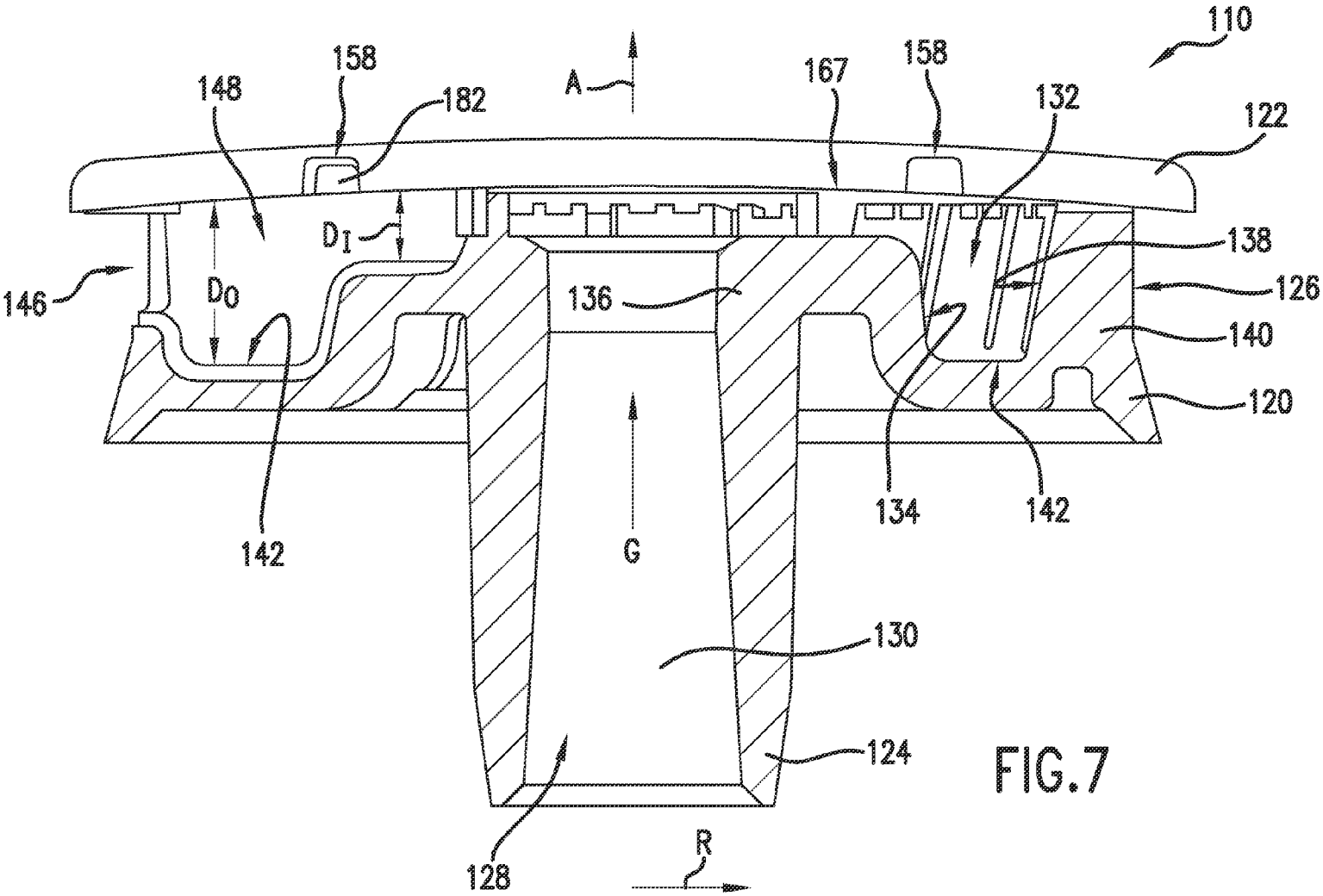
FIG. 7 is an unexploded, cross-sectional view of the exemplary burner assembly of FIG. 6.

FIGS. 6 and 7 illustrate another exemplary embodiment of a burner assembly 110 where identical reference numerals denote the same or similar features as the embodiment of FIGS. 2 through 5. For the exemplary embodiment of FIGS. 6 and 7, cap 122 has an annular groove 158 that separates a center portion 163 with surface 167 from an outer, annular portion 165 with surface 169. Unlike the previous embodiment, inner surface 167 is not recessed relative to outer surface 169.

Sidewall 140 defines a simmer flame port 146 that is spaced along circumferential direction C from primary burner ports 144 and is configured to provide a reignition source for burner ports 144. Again, while only a single simmer flame port 146 is shown, it should be understood that multiple such ports could be used. Simmer flame port 146 provides a path for fluid communication with stability chamber 148. Both port 146 and chamber 148 are substantially isolated from main fuel chamber 132 and are relatively independent from primary burner ports 144.

As shown, stability chamber 148 is defined along its sides by a pair of radially extending baffle 150, 152 that are positioned in an opposing manner from each other along circumferential direction C, along a bottom by an upper surface 142 of burner body 120, and along a top by an annular projecting portion 164 of burner cap 122. End wall 156 is positioned proximate to gas outlet 172 of burner throat 130 and further defines stability chamber 148 in this exemplary embodiment.

Stability chamber 148 has a pair of stability chamber gas inlets 174 and 175 formed as gaps or notches positioned in a symmetrical manner at ends 150*e*, 152*e* of baffles 150, 152 near gas outlet 172. For this exemplary embodiment, inlets 174 and 175 are positioned between ends 150*e*, 152*e* and end wall 156. However, inlets 174 and 175 could also be formed in baffles 150, 152 with ends 150*e*, 152*e* connected directly to end wall 156. Other configurations may also be used. While two stability chamber gas inlets 174, 175 are provided, in other exemplary embodiments 1, 3, or more inlets may be used.

As shown, stability chamber gas inlets 174 and 175 are substantially perpendicular to the direction of fuel flow, which is along radial direction R from gas outlet 172. As such, inlets 174 and 175 are tangentially fed the fuel/fuel air mixture by static pressure as fuel flows from outlet 172.

To assist in properly positioning cap 122 over burner body 120, multiple projections 154 extend along axial direction A from burner body 122 and are spaced apart along circumferential direction C from each other. The tips of projections 154 are received into annular groove 158 of cap 122. Additionally, burner body 120 also includes a pair of gas blocking projections 182 that are received in complementary manner into annular groove 158. More particularly, as shown in FIG. 7, gas blocking projections 182 extend into annular groove 158 in a manner that blocks the flow of gas along groove 158 into stability chamber 148. For this embodiment, gas blocking projections 182 are positioned immediately adjacent to baffles 150 and 152 so as to seal annular groove 158 when cap 122 is in place. In other embodiments, gas blocking projections may be formed integrally as part of baffles 150, 152; as tips extending from baffles 150, 152; or in other configurations at baffles 150, 152 that block the flow of gas into stability chamber 148 by way of annular groove 158. In addition to blocking gas flow, projections 182 also assist in positioning cap 122. One or more projections 182 may be provided.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gas burner assembly for a cooktop of an appliance, comprising:

a burner body comprising an annular sidewall surrounding a throat defined by a main gas conduit having a gas inlet and a gas outlet, the burner body defining at least one projection positioned radially inward from the annular sidewall and extending along an axial direction from the burner body;

a cap received onto the burner body, the cap defining an annular groove configured to receive the at least one projection and position the cap on the burner body, the cap having a recessed center portion positioned radially inward of the groove and located over the gas outlet;

a plurality of primary burner ports positioned along the annular sidewall of the burner body, surrounding the gas outlet, and in fluid communication with the main gas conduit through the gas outlet;

a simmer flame port disposed within the sidewall, spaced along a circumferential direction from the primary burner ports, and configured to provide a reignition source for the primary burner ports;

a stability chamber located radially adjacent to the simmer flame port, the stability chamber defined at least in part by a pair of radially extending baffles positioned in an opposing manner along the circumferential direction, each of the radially extending baffles defining a flat upper surface that extends along an entire length of the baffle along the radial direction;

an upper surface of the burner body; and the cap;

at least one stability chamber gas inlet defined by the annular groove in the cap and a top surface of one the baffles.

2. The gas burner assembly of claim 1, wherein the stability chamber is further defined by an end wall positioned radially inward of the simmer flame port and joining radially inward ends of the baffles.

3. The gas burner assembly of claim 2, wherein the annular groove of the cap is positioned radially outward of the end wall.

4. The gas burner assembly of claim 2, wherein each of the radially extending baffles extends uninterrupted along the radial direction between the simmer flame port and the end wall.

5. The gas burner assembly of claim 1, wherein the at least one stability chamber gas inlet comprises a pair of opposing stability chamber gas inlets defined by the annular groove in the gap and the top surfaces of the baffles.

6. The gas burner assembly of claim 1, wherein the cap further comprises an annular projecting portion that defines a barrier wall extending about the circumferential direction, the barrier wall configured to obstruct a portion of gas flow travelling along the center portion of the cap from the gas outlet.

7. The gas burner assembly of claim 1, wherein the upper surface of the burner body defines a depth of the stability chamber nearest the simmer flame port that is greater than a depth of the stability chamber nearest the gas outlet.

8. The gas burner assembly of claim 1, wherein the burner body defines a plurality of projections received into the annular groove of the cap and spaced apart from each other along a circumferential direction.

9. The gas burner assembly of claim 1, wherein the stability chamber is further defined by an end wall positioned radially inward of the simmer flame port and joining radially inward ends of the baffles, wherein the end wall has a top surface that is positioned higher along the axial direction than the top surfaces of the baffles.

10. The gas burner assembly of claim 1, wherein the burner body defines a toroidal projection around the gas outlet, and wherein the annular sidewall and the toroidal projection define a main fuel chamber for the receipt of gas from the gas outlet.

* * * * *